US008726527B2

(12) United States Patent
Constantine et al.

(10) Patent No.: US 8,726,527 B2
(45) Date of Patent: May 20, 2014

(54) DUAL DRIVE PENCIL SHARPENER

(75) Inventors: Richard Steven Constantine, Milford, CT (US); Man For Ma, New Territories (CN)

(73) Assignee: Acme United Corporation, Fairfield, CT (US)

( * ) Notice: Subject to any disclaimer, the term of this patent is extended or adjusted under 35 U.S.C. 154(b) by 308 days.

(21) Appl. No.: 13/348,197

(22) Filed: Jan. 11, 2012

(65) Prior Publication Data

US 2013/0174429 A1 Jul. 11, 2013

(51) Int. Cl.
*B43L 23/00* (2006.01)

(52) U.S. Cl.
USPC ..... 30/453; 30/454; 30/459; 144/28.1

(58) Field of Classification Search
USPC ..... 30/453–459, 122, 461–462, 452, 451; 144/28.2, 28.1, 28.11, 28.3, 28.4, 28.9; 408/226; 403/378; 192/69.61–69.63, 192/65, 66.1, 66.31, 69.62; 33/451–462
See application file for complete search history.

(56) References Cited

U.S. PATENT DOCUMENTS

| | | | | |
|---|---|---|---|---|
| 2,307,119 | A * | 1/1943 | Duany | 144/28.11 |
| 2,470,387 | A * | 5/1949 | Baggett | 144/28.11 |
| 4,050,487 | A * | 9/1977 | Mabuchi et al. | 144/28.5 |
| 4,231,405 | A | 11/1980 | Vila | |
| 5,379,817 | A * | 1/1995 | O'Neil et al. | 144/363 |
| 5,394,613 | A | 3/1995 | Ku | |
| 6,237,656 | B1 * | 5/2001 | Whitehead et al. | 144/28.3 |
| 6,473,976 | B1 * | 11/2002 | Cocchiarella | 30/453 |
| 6,494,638 | B1 | 12/2002 | Donaldson | |
| 7,225,547 | B2 * | 6/2007 | Luttgens | 30/457 |
| 2007/0068013 | A1 * | 3/2007 | Lau | 30/454 |
| 2009/0115145 | A1 * | 5/2009 | Gehret et al. | 279/62 |
| 2011/0258863 | A1 * | 10/2011 | Hammer | 30/457 |
| 2011/0262224 | A1 * | 10/2011 | McCandless et al. | 403/376 |
| 2011/0265911 | A1 | 11/2011 | Hammer | |

OTHER PUBLICATIONS

Search Report.

* cited by examiner

*Primary Examiner* — Boyer D Ashley
*Assistant Examiner* — Fernando Ayala
(74) *Attorney, Agent, or Firm* — Alix, Yale & Ristas, LLP

(57) ABSTRACT

A portable pencil sharpener is capable of being manually operable or operable to be driven by a remote torque driver. The pencil sharpener is capable of sharpening either a carpenter's pencil or a Number 2 pencil. Pencil shavings are retained in a compact housing and removed through a retractable panel.

15 Claims, 9 Drawing Sheets

DUAL DRIVE PENCIL SHARPENER

BACKGROUND

This disclosure relates generally to hand held mechanical pencil sharpeners. More particularly, this disclosure relates to portable, compact mechanical sharpeners which sharpen a pencil and retain the shavings within a housing.

SUMMARY

Briefly stated, a dual drive mode pencil sharpener comprises a housing defining a central axis and having a first end and an axially spaced second end. A sharpener comprising a blade is mounted in the housing and is rotatable relative to the housing about the central axis. An axial pencil slot is defined in the first end and alignable with the sharpener. A coupler is rotatably fixed with the sharpener and has an engagement interface accessible at the second end. The coupler has a clutch mechanism. In a first mode, the clutch mechanism rotatably fixes the housing with the sharpener, and in a second mode, the clutch mechanism allows the sharpener to be rotatable relative to the housing.

The axial slot preferably has a geometry which will accommodate a carpenter's pencil or a No. 2 pencil. In one embodiment, the engagement interface is a hex socket. The housing comprises a retention rim which defines two diametrically disposed detents. The coupler has two opposed axially extending slots. A follower rod projects through and beyond each slot and is receivable in the detents in the first drive mode. A driver insertable into the socket transforms the pencil sharpener to the second drive mode wherein the driver is drivable to rotate the sharpener relative to the housing.

In one embodiment, a dual drive mode pencil sharpener comprises a housing defining a central axis and having an interior detent and a first end and an axially spaced second end. A sharpener is generally alignable with the slot and comprises a blade rotatable relative to the housing about the axis. The first end has an axial slot. The second end has a second opening. A coupler is rotatably fixed with the sharpener and has an axial socket accessible at the second opening. The coupler has an axially extending slot receiving an axially displaceable, spring-biased rod radially projecting beyond the slot. In a first drive mode, the rod is received in the detent to rotatably fix the housing with the sharpener. In a second drive mode, the rod is displaced from the detents so that the sharpener is rotatable relative to the housing.

A retractable panel allows for the removal of pencil shavings from the housing. The socket is preferably a hex socket. The housing has an inward retention rim which defines two diametrically disposed detents and has a pair of cam surfaces adjacent each said detent. The coupler has two opposed axially extending slots. The rod projects through each slot and has opposed end portions each receivable in one of the detents. When a driver is insertable into the socket, the pencil sharpener is transformed to the second drive mode and is drivable to rotate the sharpener relative to the housing. The coupler may include a plurality of axially extending radially protruding guides. The rod rotatably follows the retention rim under the bias of a spring.

DETAILED DESCRIPTION

With reference to the drawings wherein like numerals represent like parts throughout the Figures, a dual drive pencil sharpener is generally designated with the numeral 10. The pencil sharpener 10 is configurable in a manual mode or an external power mode for sharpening a pencil and is further adapted to sharpen both a carpenter's pencil 12 and a Number 2 pencil. Alternatively, the pencil sharpener 10 may readily be adapted to sharpen various other types of pencils.

Figure 2:
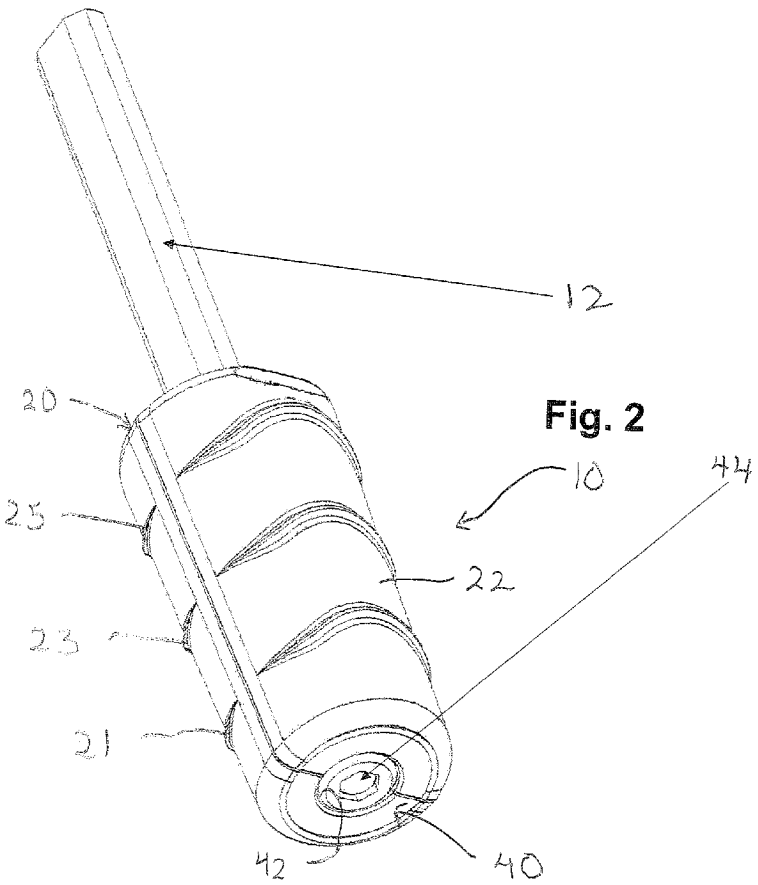
FIG. 2 is a perspective view of the pencil sharpener of FIG. 1 in a different orientation together with a carpenter's pencil which has been inserted for sharpening.
Figure 1:
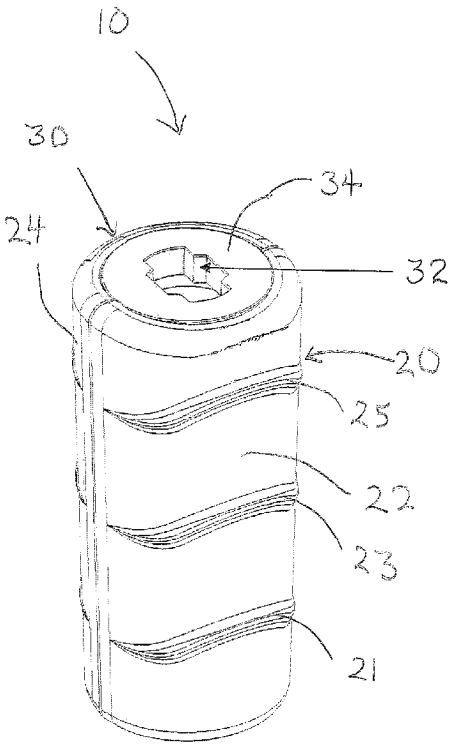
FIG. 1 is a perspective view of a dual drive pencil sharpener.
Figure 3:
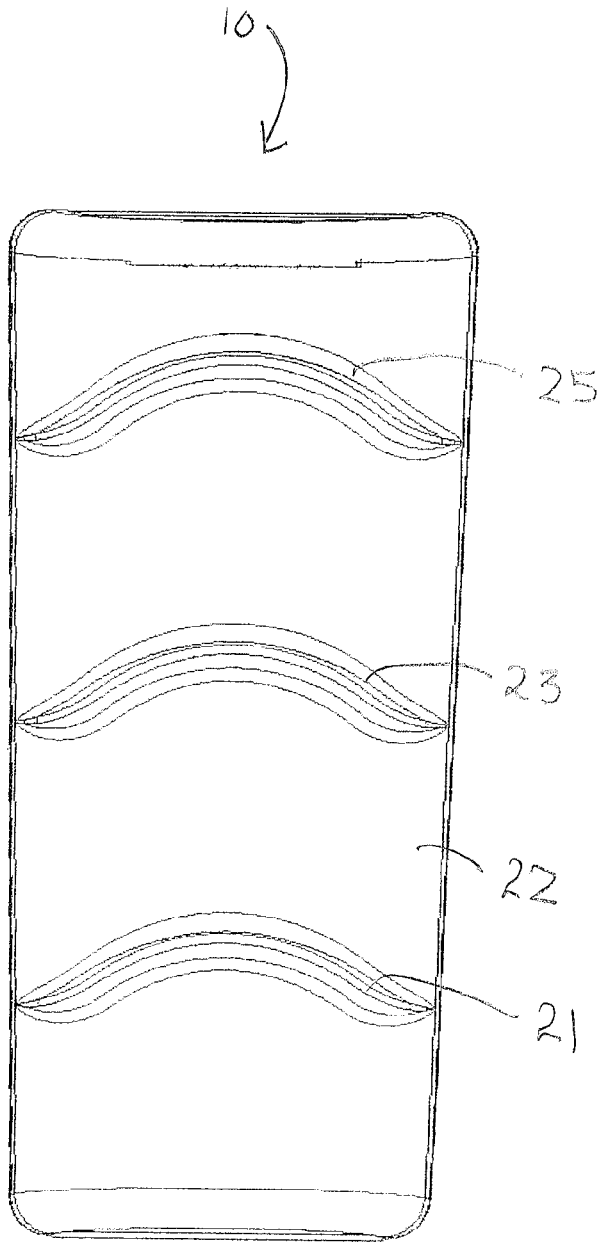
FIG. 3 is a front view of the dual drive pencil sharpener of FIG. 1.
Figure 4:
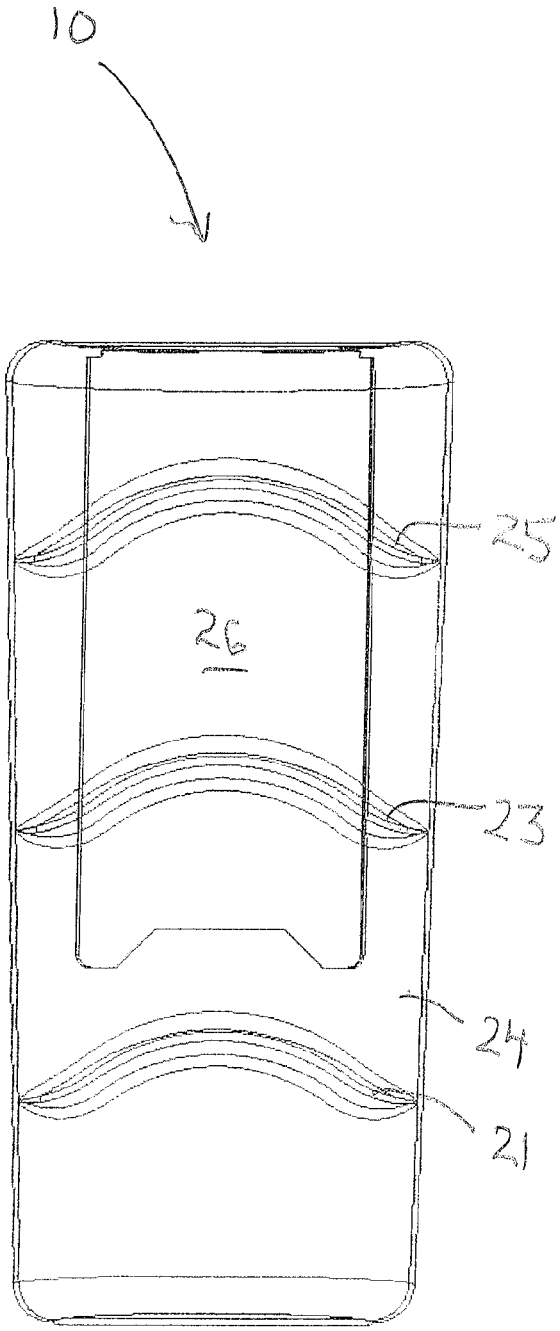
FIG. 4 is a rear view of the dual drive pencil sharpener of FIG. 1.
Figure 5:
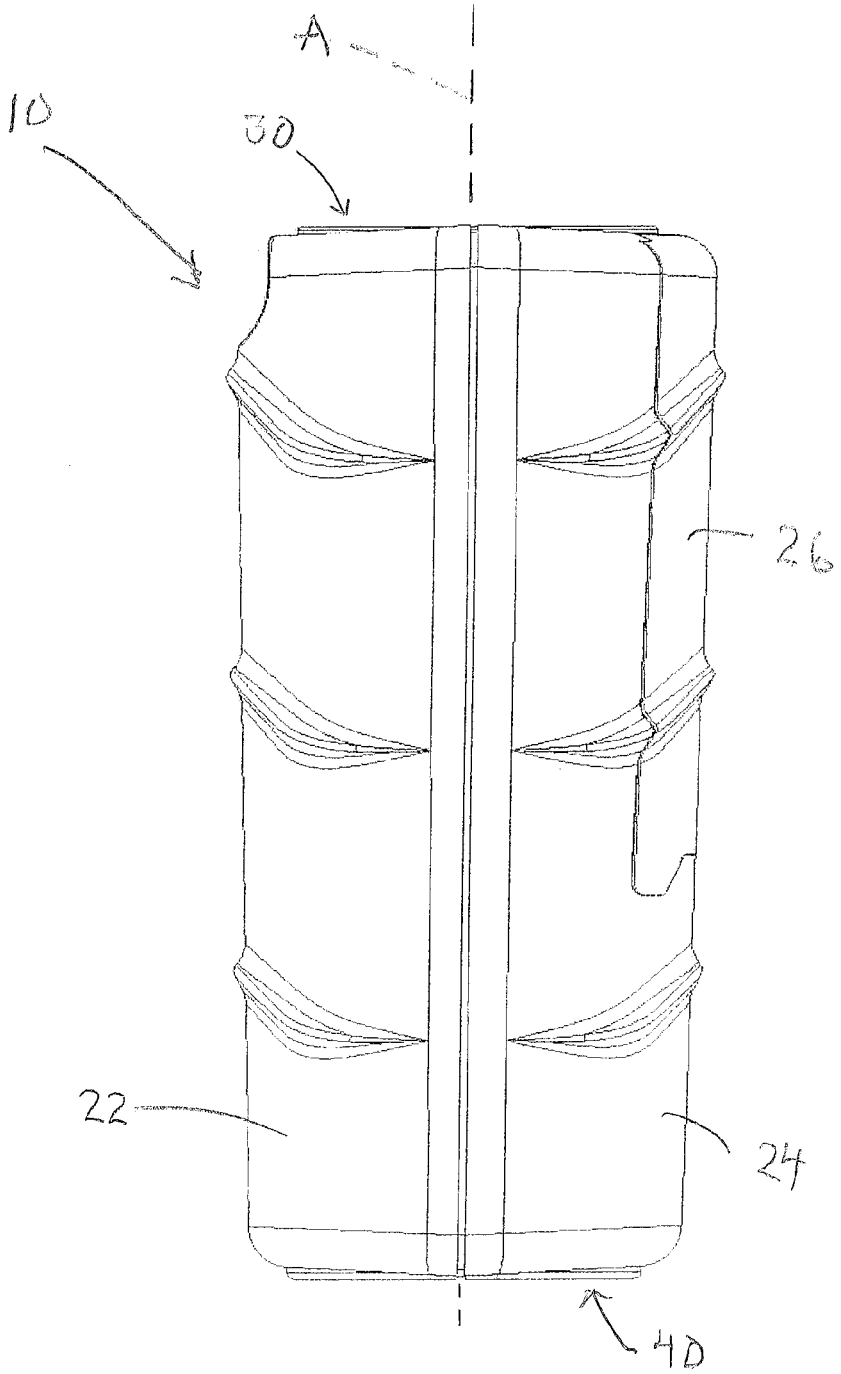
FIG. 5 is a left side view, partly diagrammatic, of the dual drive pencil sharpener of FIG. 1.
Figure 7:
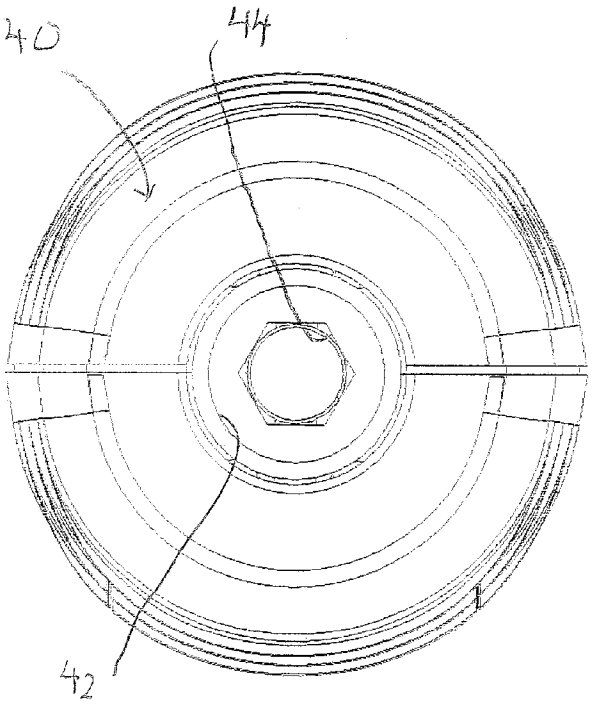
FIG. 7 is an opposite end view of the dual drive pencil sharpener of FIG. 1.
Figure 6:
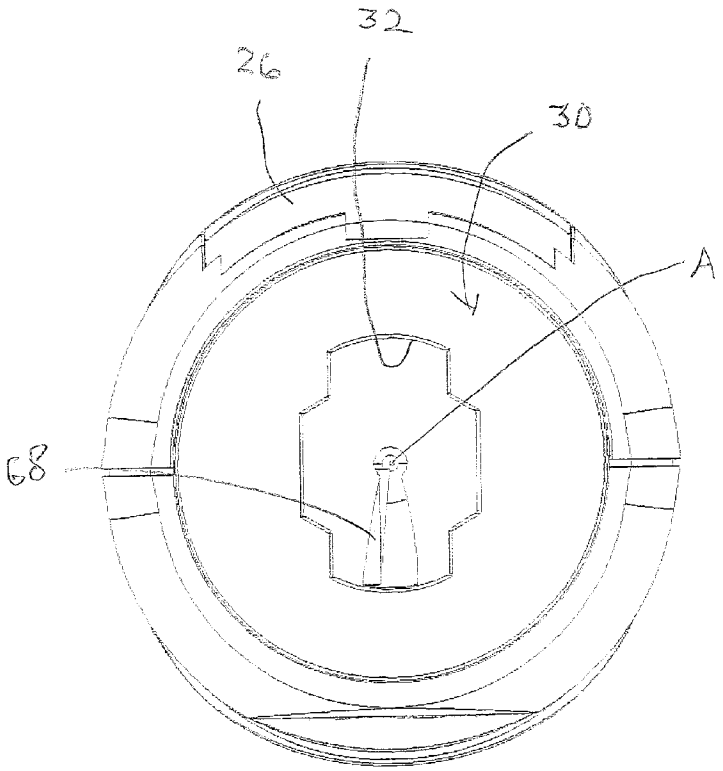
FIG. 6 is an end view of the dual drive pencil sharpener of FIG. 1.

The pencil sharpener 10 has a slightly tapered, quasi-cylindrical housing 20 principally defined by two cooperative housing shells 22 and 24. The shells 22 and 24 interlock along a generally planar parting interface which further defines a central axis A (FIG. 5). The shells are exteriorly traversed by a spaced series of wave-like ridged groups 21, 23 and 25. Pencil shavings are initially retained within the housing 20. Shell 24 has an axially slidable panel 26 to allow removal of retained pencil shavings.

The pencil housing has a working input end 30 which includes a quasi-cross-shaped slot 32 adapted to either accept a carpenter's pencil 12 or a Number 2 pencil (not illustrated). Other slot configurations are possible. The opposing end 40 of the housing includes an opening 42 which provides access to a hexagonal socket 44, the function of which is described below.

Interiorly extending structures of the shells 22 and 24 cooperate to interiorly mount and form an enclosure 50 for a sharpener assembly 60. Three interior axially spaced shelf bearings 52, 54, and 56 project from the shells 22 and 24 and an axially spaced cam-like retention rim 58 radially projects integrally from the shells 22 and 24. Bearings 52, 54 and 56 and rim 58 are formed in substantially identical arcuate sections and are generally symmetric about the central axis A which also functions as an operative rotational axis. The composite shelf bearings 52, 54 and 56 are substantially annular in shape.

The sharpener assembly 60 includes a medial platform 62 which integrally connects with an upper mount frame 66. A blade 68 is mounted to the frame 66 at an angle to the central axis A through the assembly to present a cutting edge to thereby produce a generally conically shaped point to a Number 2 pencil and/or a quasi-truncated conical shaped point to the carpenter's pencil. The medial platform 62 includes a circumferential annular recess 64 which is generally complementary with the medial shelf bearing 52 so that upon mating with the bearing, the medial platform 62 is freely rotatable around the bearing 52 within the housing 20 and about the central axis A.

The upper portion of the frame 66 supports an upper annular platform 70 which also includes a recess 72 and mates in bearing relationship with an upper shelf 54 for rotational inter-engagement therewith.

Figure 8:
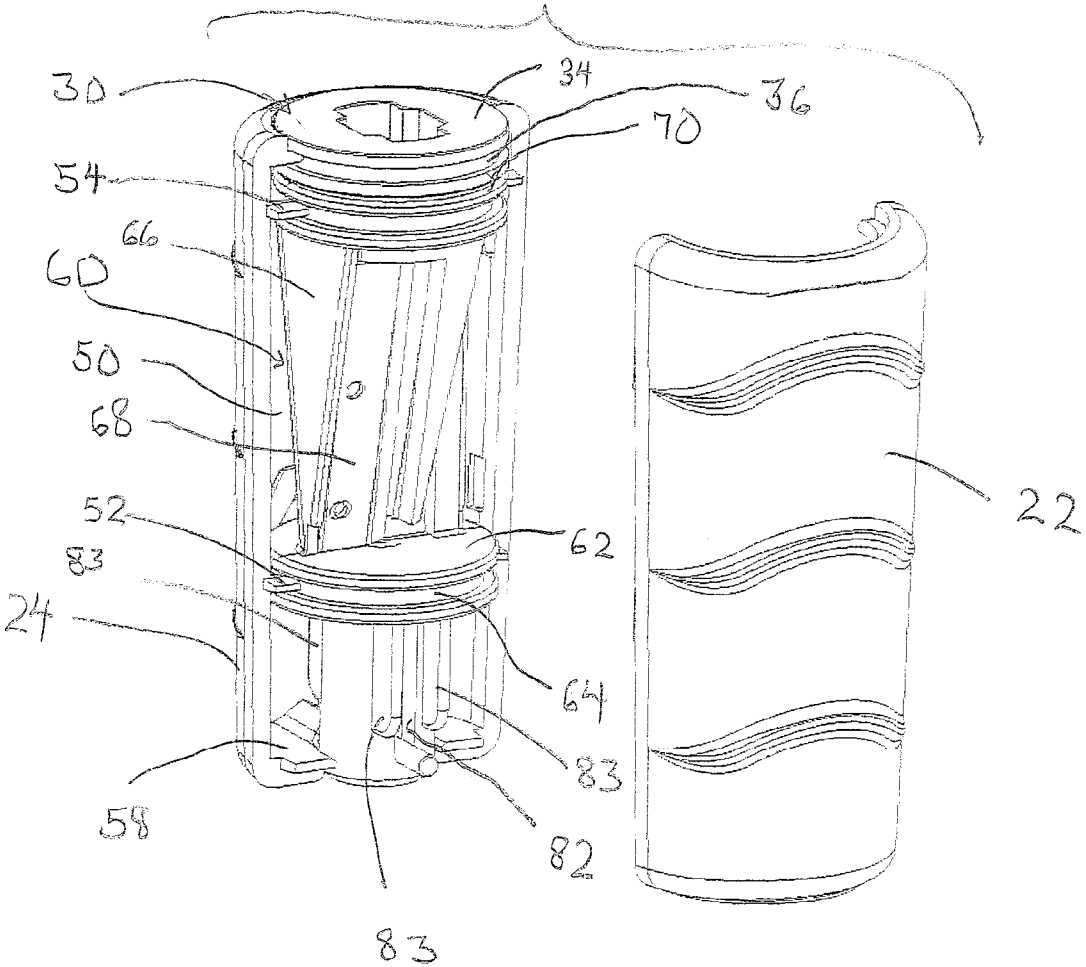
FIG. 8 is an exploded view of the dual drive pencil sharpener of FIG. 1.
Figure 9:
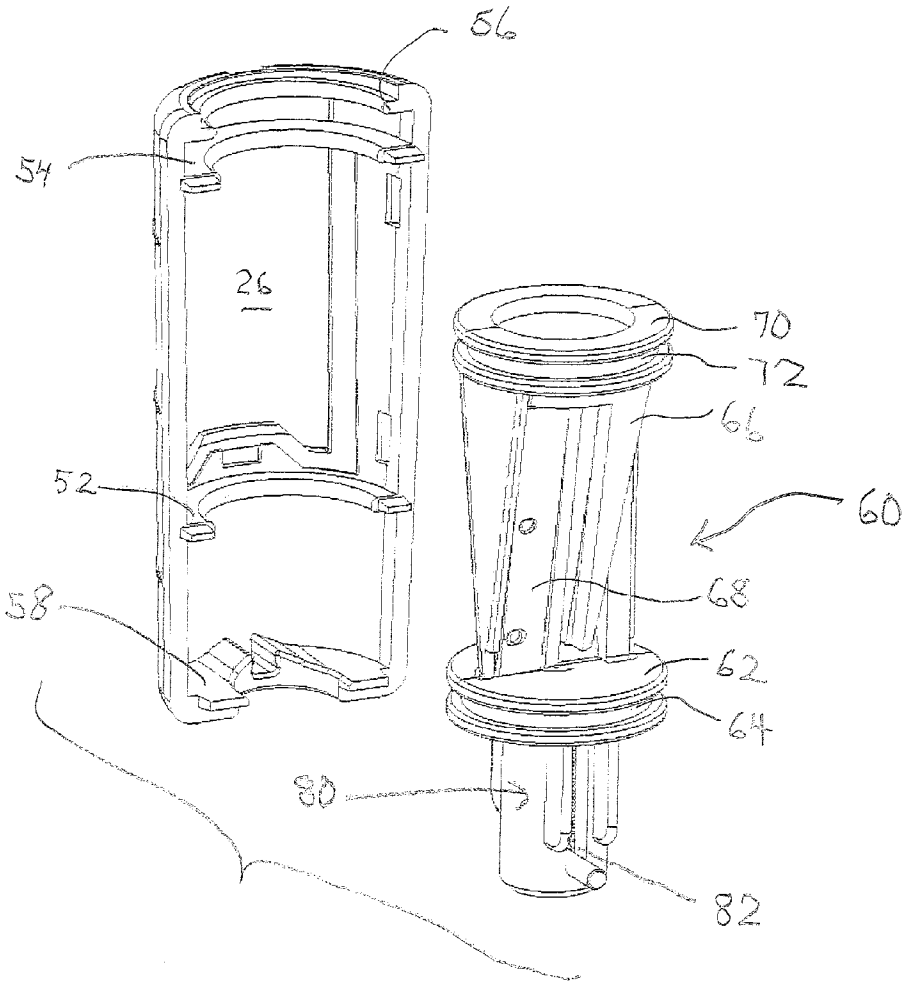
FIG. 9 is an exploded view of a portion of the dual drive pencil sharpener of FIG. 8.
Figure 10:
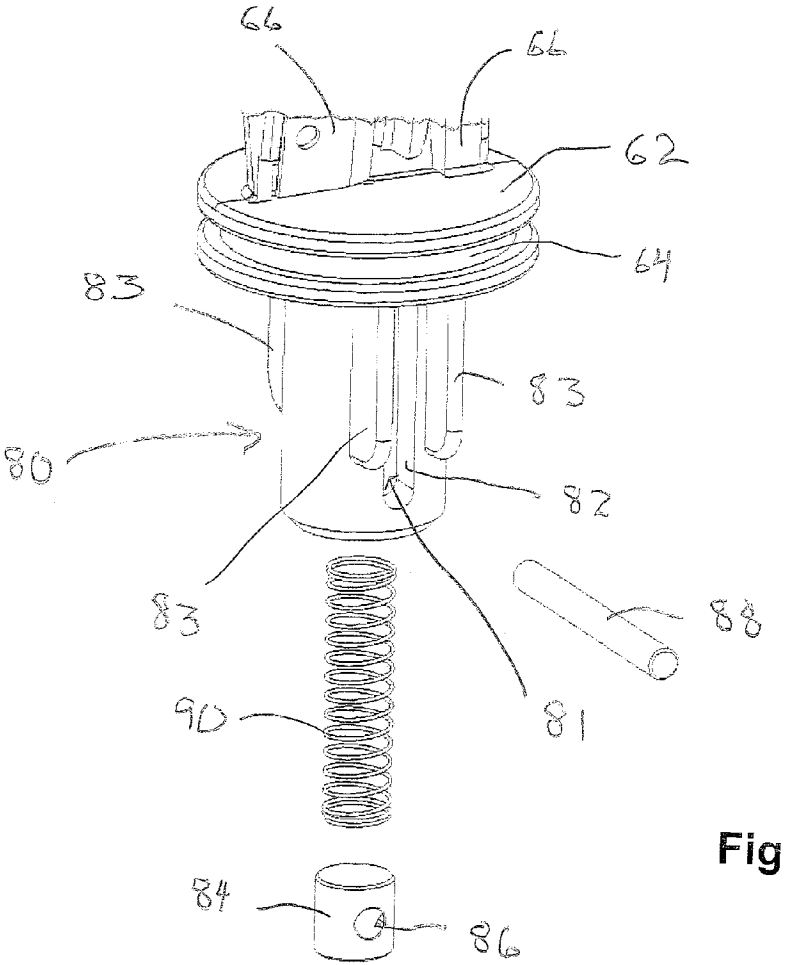
FIG. 10 is a fragmentary exploded view of a portion of the dual drive pencil sharpener illustrated in FIG. 9.

With reference to FIG. 8, the working end 30 has a generally disk-like panel 34 which includes the cross-shaped slot 32 and, at its edge, also includes a peripheral circumferential intermediate annular recess 38. The recess 38 receives the shelf bearing 56. The working end is supported at the top of the upper platform 70 and is generally independently rotatable therewith.

With reference to FIG. 8-12, an elongated cage-like coupler 80 integrally extends below the medial platform 62 and is rotatably fixed with respect to the platform 62 and the frame 66. The coupler 80 has a central axial cavity 81 and a pair of opposed axial slots 82 (only one slot illustrated). Angularly spaced, radially projecting, axial guides 83 extend from the coupler to stabilize the coupler movement. The lower underside of the coupler terminates in the hexagonal socket 44. Other torque drive interfaces are also possible.

A plug 84 includes a cross-bore 86 which receives a follower rod 88. The diameter of rod 88 is commensurate with the width of the slots 82, but is slightly smaller to allow sliding axial movement in the slots 82. A coil spring 90 is disposed at the top of the plug 84. The spring 90 and the plug 84 are disposed in the cavity 81. Portions of the coupler body are removed in FIGS. 11 and 12 for clarity. One end (upper) of the spring 90 engages the underside of the platform 62 to bias the plug 84 and follower rod 88 away from the platform (downwardly in FIG. 11).

The retention rim 58 includes a pair of cooperative ramps or cams 92 which lead to a detent 94 at diametrally opposed rim locations. The end portions of rod 88 rotatably follow the contours of the retention rim including the cams 92. The detents 94 (only one illustrated) are dimensioned to rotatably capture the ends of the follower rod 88.

Figure 11:
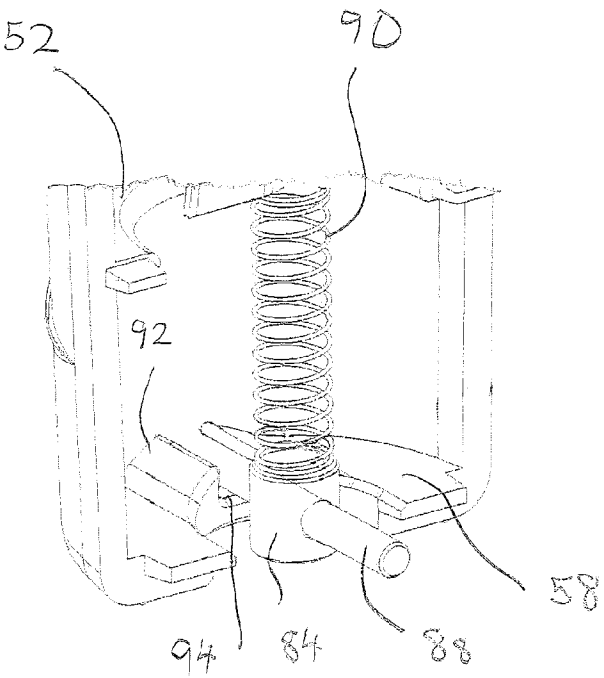
FIG. 11 is a fragmentary interior perspective view, portions removed, of the pencil sharpener portion of FIG. 10 upon assembly and illustrated in a manual sharpening mode.

As best illustrated in FIG. 11, in a manual mode the opposed ends of the rod 88 are received in the opposed detents 94. Because the rod rotatably engages the side walls of the coupler slots 82 under the bias of spring 90, the sharpener assembly 60, including the blade, is essentially rotatably fixed with respect to the housing 20. An electric/battery powered drill preferably provides the driver power.

Figure 12:
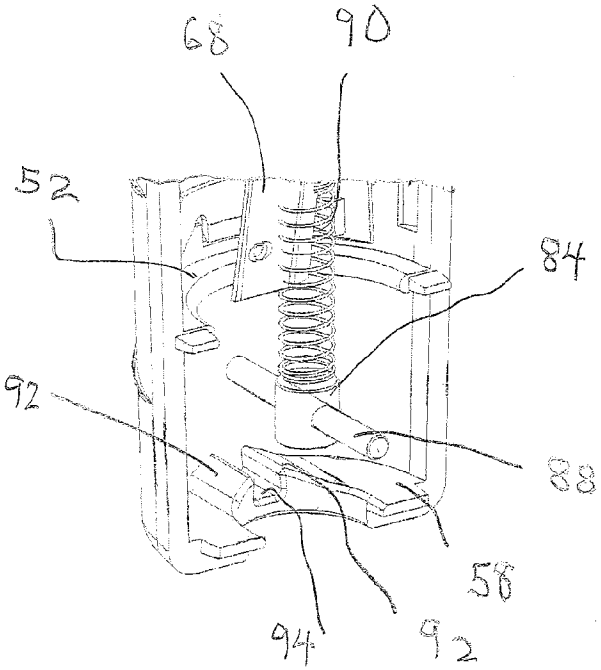
FIG. 12 is a fragmentary interior perspective view, portions removed, of the pencil sharpener of FIG. 10 upon assembly and illustrated in an external power mode.

With reference to FIG. 12, in the event that a torque drive in the form of a hexagonal driver is inserted into the socket 44 and rotatable with the socket, the plug 84 lifts against the bias of the spring 90 to displace the rod 88 from the detents 94, and correspondingly the sharpener assembly 60 is now rotatable relative to the sharpener housing 20.

It will be appreciated that the sharpener 10 is operable in one of two drive modes. In a manual mode a pencil is inserted into the end 30 of the sharpener and the sharpener is manually rotated by rotating the housing 20 about the axis to sharpen the point while the pencil is held stationary. The rod 88 engages the detents under the bias of the spring 90, and thus sharpener assembly 60 is rotatably fixed with the housing 20, while the end 30 is stationary with the pencil.

In an external drive mode, a driver is inserted into the socket 44 which is in the fixed rotational relationship with the sharpener/coupler. Upon rotation of the driver, the sharpener assembly 60 rotates within the housing 20, and thus the pencil, which is firmly grasped, is sharpened under the drive of the external driver.

What is claimed is:

1. A dual drive mode pencil sharpener comprising:

a housing defining a central axis and having a first end and an axially spaced second end, said housing having an interior detent, said first end defining an axial slot and said second end defining a second opening;

a sharpener comprising a blade mounted in said housing and rotatable relative to said housing about said axis;

a coupler rotatably fixed with said sharpener and having an axial socket accessible at said second opening and having an axially extending slot receiving an axially displaceable spring-biased rod radially projecting beyond said slot;

wherein in a first automated mode, said rod is received in said detent to rotatably fix the housing with said sharpener, and in a second manual mode, said rod is displaced from said detent so that said sharpener is rotatable within and relative to said housing.

2. The pencil sharpener of claim 1 wherein said axial slot has a geometry which will accommodate a carpenter's pencil or a Number 2 pencil.

3. The pencil sharpener of claim 1 wherein said socket is a hex socket.

4. The pencil sharpener of claim 1 wherein said housing has an inward retention rim which defines two diametrically disposed detents and has a pair of cam surfaces adjacent each said detent.

5. The pencil sharpener of claim 4 wherein said coupler has two opposed axially extending slots, and said rod projects through each said slot and has opposed end portions each receivable in a said detent.

6. The pencil sharpener of claim 1 and further comprising a retractable panel for removing pencil shavings from the housing.

7. The pencil sharpener of claim 1 wherein a driver insertable into said socket transforms said pencil sharpener to the second mode and is drivable to rotate said sharpener relative to said housing.

8. A dual drive mode pencil sharpener comprising:

a housing defining a central axis and having a first end and an axially spaced second end;

a sharpener comprising a blade mounted in said housing and rotatable relative to said housing about said axis;

an axial pencil slot defined in said first end alignable with said sharpener; wherein said clutch mechanism comprises a member which extends through an axial slot in said sharpener, and said member is selectively engaged with a detent in said housing;

a coupler rotatably fixed with said sharpener and having an engagement interface accessible at said second end and having a clutch mechanism;

wherein in a first automated mode, said clutch mechanism rotatably fixes the housing with said sharpener, through said rod being engaged with said detent, and in a second manual mode, said clutch mechanism allows said sharpener to be rotatable within and relative to said housing through said member being disengaged from said detent.

9. The pencil sharpener of claim 8 wherein said axial slot has a geometry which will accommodate a carpenter's pencil or a Number 2 pencil.

10. The pencil sharpener of claim 8 wherein said engagement interface is a hex socket.

11. The pencil sharpener of claim 8 wherein said housing comprises a retention rim which defines two diametrically disposed detents and said coupler has two opposed axially extending slots, and said member comprises a rod projecting through and beyond each said slot and being receivable in said detents in said first mode.

12. The pencil sharpener of claim 8 and further comprising a retractable panel for removing pencil shavings from the housing.

13. The pencil sharpener of claim 10 wherein a driver insertable into said socket transforms said pencil sharpener to the second mode and is drivable to rotate said sharpener relative to said housing.

14. The pencil sharpener of claim 8 wherein said coupler comprises a plurality of axially extending radial guides.

15. The pencil sharpener of claim 11 wherein said rod rotatably engages said retention rim under the bias of a spring.

* * * * *